United States Patent [19]

Focke

[11] Patent Number: 4,962,629

[45] Date of Patent: Oct. 16, 1990

[54] APPARATUS FOR THE TESTING OF CIGARETTES

[75] Inventor: Heinz Focke, Verden, Fed. Rep. of Germany

[73] Assignee: Focke & Co. (GmbH & Co.), Verden, Fed. Rep. of Germany

[21] Appl. No.: 337,694

[22] Filed: Apr. 13, 1989

[30] Foreign Application Priority Data

Apr. 16, 1988 [DE] Fed. Rep. of Germany ..... 3812689

[51] Int. Cl.[5] ..... B65B 1/44

[52] U.S. Cl. ..... 53/498; 53/151; 209/536

[58] Field of Search ..... 53/54, 52, 151, 150, 53/149, 148, 498, 493; 209/536, 535, 537

[56] References Cited

U.S. PATENT DOCUMENTS 4,574,958 3/1986 Manservisi ..... 53/151 X
4,648,232 3/1987 Brinker et al. ..... 53/54

FOREIGN PATENT DOCUMENTS 0100537 2/1984 European Pat. Off. .
2100351 3/1972 Fed. Rep. of Germany .
2739366 7/1978 Fed. Rep. of Germany .
3219044 12/1982 Fed. Rep. of Germany .
3609094 10/1986 Fed. Rep. of Germany .
3620735 12/1987 Fed. Rep. of Germany .
3640491 6/1988 Fed. Rep. of Germany .

*Primary Examiner*—James F. Coan
*Attorney, Agent, or Firm*—Sughrue, Mion, Zinn, Macpeak & Seas

[57] ABSTRACT

An apparatus for the testing of cigarettes.

In the packaging of cigarettes, it is necessary to test these for correct formation, especially for a complete filling of tobacco. For this purpose, a testing unit (13) is arranged within a cigarette magazine (10) and has a plurality of vertical test shafts (18), in the region of which the cigarettes are tested by optoelectrical sensors. The intact cigarettes subsequently pass into a cigarette stock (21) in free fall.

To guarantee an orderly fault-free transfer of the tested cigarettes to the cigarette store (15), guide shafts (b 28) are formed underneath the test shafts (18) as a continuation of these and lead to a point immediately above the cigarette stock (21). The guide shafts (28) limited by vertical plane guide-shaft walls (29) guarantee that the cigarettes are deposited in an orderly manner and without tilting.

There are also measures to clean the sensors for testing the cigarettes.

14 Claims, 8 Drawing Sheets

Fig. 6
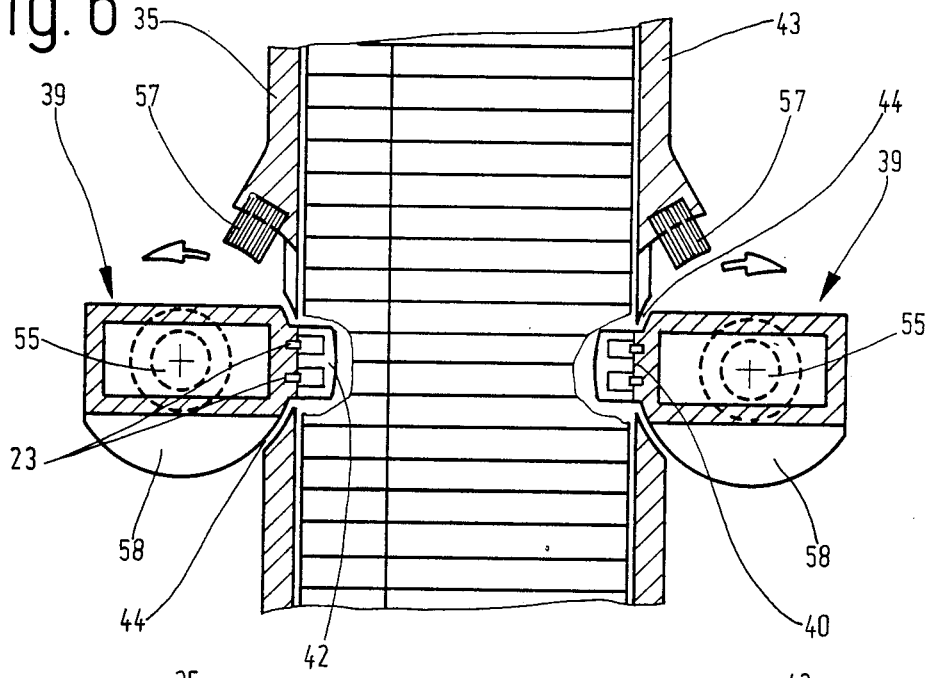
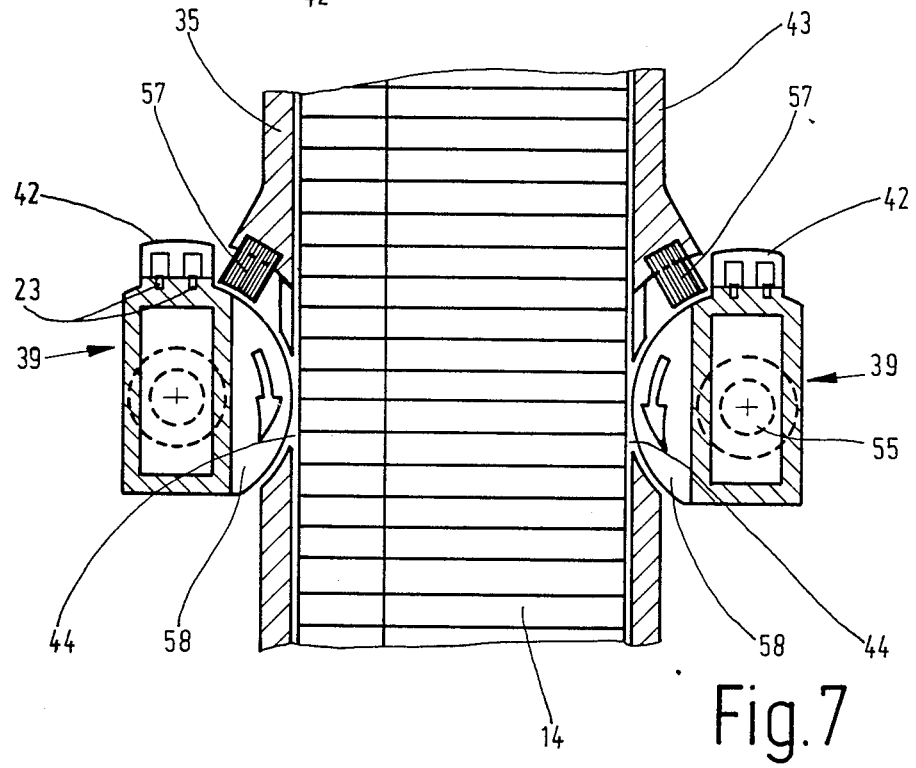
Fig. 7

APPARATUS FOR THE TESTING OF CIGARETTES

BACKGROUND OF THE INVENTION

The invention relates to an apparatus for the testing of cigarettes in conjunction with a packaging machine, rows of cigarettes located above one another being guided through a testing unit and being tested in the region of vertical test shafts of the latter by (optoelectrical) testing members in a test zone situated above a cigarette store formed by the tested cigarettes.

Before packaging, cigarettes are checked for correct formation, especially for a proper filling of tobacco and, if appropriate, the presence of a filter. It is expedient for the test of the cigarettes to be carried out before the formation of cigarette groups as the content of a cigarette pack. The test is appropriately carried out in the region of a cigarette magazine or immediately in front of this.

In the apparatus according to the older German patent application No. P 37 29 213.7 corresponding to copending U.S. patent application No. 07/236,489, a testing unit having a plurality of vertical test shafts located next to one another is arranged in an enlarged cigarette magazine. A vertically downward-running row of cigarettes arranged above one another is formed in each of these test shafts. The testing of the cigarettes is carried out in the region of their ends during a temporary standstill phase. The defective cigarettes are separated out of the testing unit in their longitudinal direction, whilst the intact cigarettes pass downwards into the region of a cigarette store as result of their own weight.

A problem with this is that the cigarettes drop over a relatively great height in free fall before they strike the cigarettes in the cigarette store. This can result in damage to the cigarettes and also in slanted positions.

SUMMARY OF THE INVENTION

Starting from this, the object on which the invention is based is to guarantee greater safety in the region of the testing unit, especially as regards the further transport of the tested cigarettes.

To achieve this object, the apparatus according to the invention is defined in that guide shafts are formed as a continuation of the test shafts underneath the test zone and terminate above the cigarette store. According to the invention, the guide shafts are limited by vertical guide-shaft walls which extend in the same planes as test-shaft walls limiting the test shafts.

The guide shafts perform a guiding and steering function for the tested cigarettes conveyed downwards in free fall. The downward movement of the cigarettes is guided and braked slightly by the vertical guide shafts. The cigarettes, after coming out of the guide shafts, pass in an aligned relative position onto the cigarettes present in the cigarette store.

A further subject of the invention is the arrangement of testing members. According to the invention, the optoelectrical sensors located in the region of end faces of the cigarettes are arranged on a carrier (test beam) and are movable by means of the latter into a testing position and out of this.

The test beam, together with the sensors, can be moved out of the testing position for various reasons, especially for cleaning purposes. The sensors are exposed to considerable soiling with dust and have to be cleaned from time to time. According to the invention, this is carried out by moving the testing members out of the testing position, and as result of the movement of the test beam the sensors are preferably moved past cleaning tools of fixed location or stationary.

When sensors are arranged on the one hand in the region of the end faces of the cigarettes and on the other hand in the region of side faces near the ends, the test beam is made comb-like, sensors being arranged on the one hand in the region of recesses and on the other hand on side faces of projections of the test beam.

The stationary cleaning tools are preferably cleaning brushes which are mounted in a suitable relative position on the front wall and rear wall of the cigarette magazine.

Further features of the invention relate on the one hand to the formation and arrangement of the guide shafts and on the other hand to the design of the cigarette magazine in respect of the testing members.

BRIEF DESCRIPTION OF THE DRAWING

The invention is explained in detail by means of exemplary embodiments. In the drawing: FIG. 6 shows a vertical section through the cigarette magazine in the region of testing members, FIG. 7 shows a representation corresponding to that of FIG. 6, with testing members in a changed relative position.

DETAILED DESCRIPTION OF PREFERRED EMBODIMENTS

Figure 1:
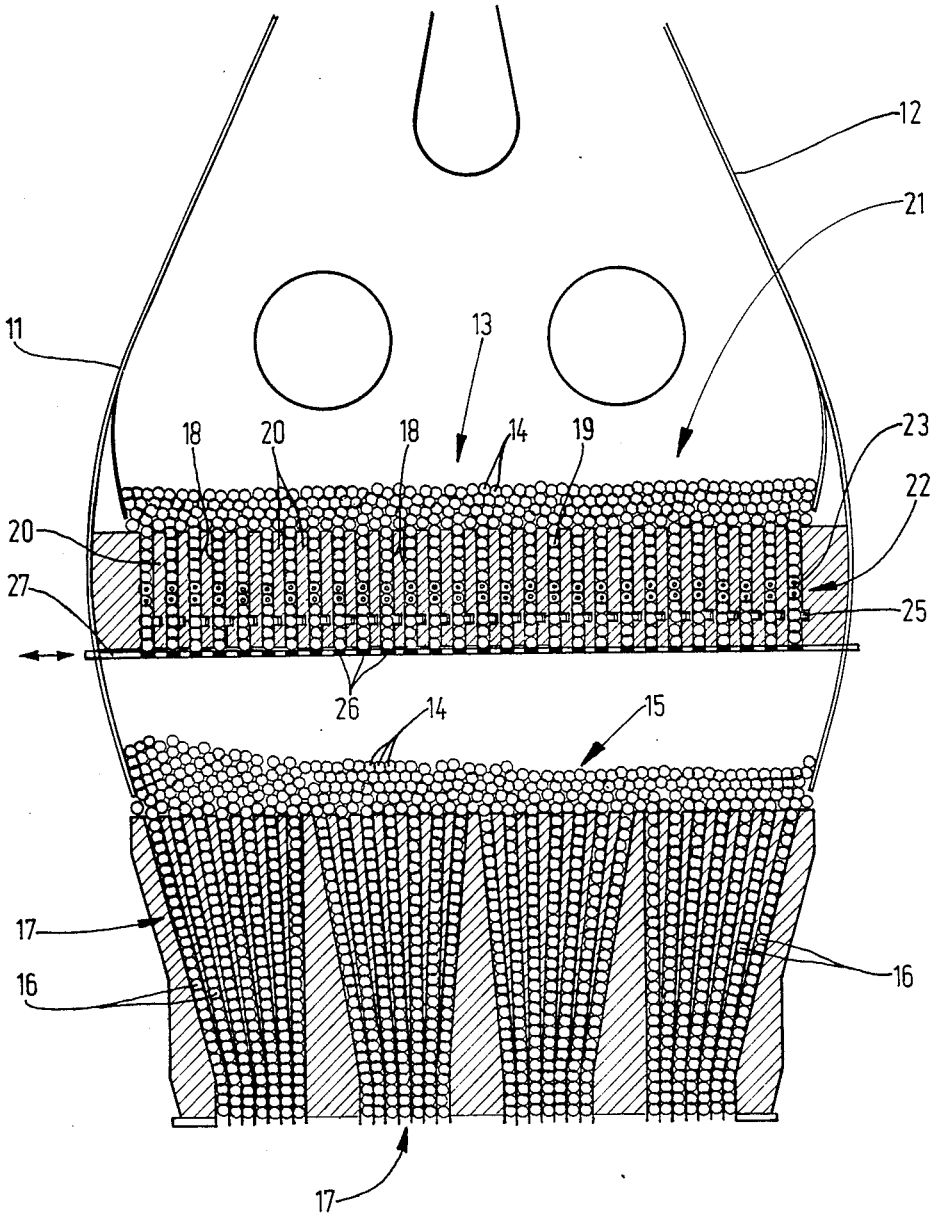
Fig. 1 (PRIOR ART)
FIG. 1 shows a front view and vertical section of part of a cigarette magazine in an older version, FIG. 2 likewise shows a front view and vertical section of a cutout of the cigarette magazine in a version according to the invention, on an enlarged scale (sectional plane II—II in FIG. 3)

FIG. 1 shows a cigarette magazine 10 in the version of the older patent application No. P 37 29 213.7. A testing unit 13 is arranged in an inner space limited by side walls 11, 12, approximately of half the height of the side walls 11, 12, converging upwards and downwards. Cigarettes 14 are checked in this testing unit 13 for a correct formation. Correctly formed cigarettes pass into a cigarette store 15 underneath the testing unit 13. In contrast, defective cigarettes are ejected in the longitudinal direction in the region of the testing unit 13.

The cigarette store 15 is located above magazine shafts 16 or above shaft groups 17 of such magazine shafts. At the lower ends of the magazine shafts 16, cigarette groups are ejected in the longitudinal direction of the cigarettes in proportion to the content of a cigarette pack. This corresponds to the conventional mode of operation of a cigarette magazine 10.

The testing unit 13 consists of a plurality of vertical test shafts 18 formed next to one another. In each of these is a cigarette row 19 of individual cigarettes 14 located above one another. The test shafts 18 are limited by a corresponding number of vertical and parallel test-shaft walls 20. A sufficient cigarette stock 21 is maintained constantly above the testing unit 13 by introducing appropriate quantities of cigarettes via an upper orifice in the cigarette magazine 10.

The cigarettes 14 are tested in the region of a test plane 22 by testing members, particularly optoelectrical sensors. As described in detail further below, these are on the one hand transmitters 23 and on the other hand receivers 24. In the exemplary embodiment illustrated, two cigarettes located above one another in a test shaft 18 are tested simultaneously in the test plane 22 by a respective group of testing members.

During the test, the cigarettes 14 are secured momentarily in the test shafts 18, in the illustrated exemplary embodiment by clamping fingers 25 which are arranged laterally in the test shafts 18 and which each press a cigarette against a test-shaft wall 20 below the test plane 22.

At the lower outlet end of the test shafts 18, the cigarettes of the cigarette row 19 rest temporarily on a supporting member, particularly on supporting webs 26 of a comb-like transversely movable cigarette carrier 27. In the closing position for the test shafts 18 (FIGS. 1 and 2), the cigarettes previously identified as defective are ejected in the longitudinal direction. The cigarette carrier 27 is thereafter shifted transversely, so that the supporting webs 26 extend underneath the test-shaft walls 20. With cigarettes being clamped simultaneously by the clamping fingers 25, the two particular cigarettes located underneath the clamping fingers 25 can now pass downwards into the cigarette store 15.

The tested cigarettes are transferred to the cigarette store 15 by free fall. This is controlled by guide shafts 28 which are formed underneath the testing unit 13 in an extension or as a continuation of the test shafts 18. The guide shafts 28 are limited by vertical guide-shaft walls 29 which continue downwards in the planes of the test-shaft walls 20 and which are of the same width. The guide shafts 28 terminating immediately above the cigarette store 15 cause an aligned ordered fall movement of the tested cigarettes 14.

The level of the cigarettes 14 in the region of the cigarette store 15 is monitored, specifically by transversely directed check barriers (light barriers). A lower check barrier 30 marks the permissible minimum level of cigarettes within the cigarette store 15. If the cigarette stock decreases further, the following packaging machine is switched off.

A middle check barrier 31 in the region of the cigarette store 15 marks the "normal stock" of cigarettes in the cigarette store 15. Upward or downward deviations give rise to a, within predetermined limits, higher output of either the packaging machine or a cigarette-producing machine preceding the cigarette magazine.

An upper check barrier 32 extends in the upper part of the guide shafts 28. If cigarettes have accumulated in the cigarette store 15 until there is a backflow into the guide shafts 28 as far as the check barrier 32, the supply of cigarettes to the cigarette magazine 10 is interrupted. The guide-shaft walls 29 are equipped with passage bores 33 for the passage of the check barrier 32.

Figure 3:
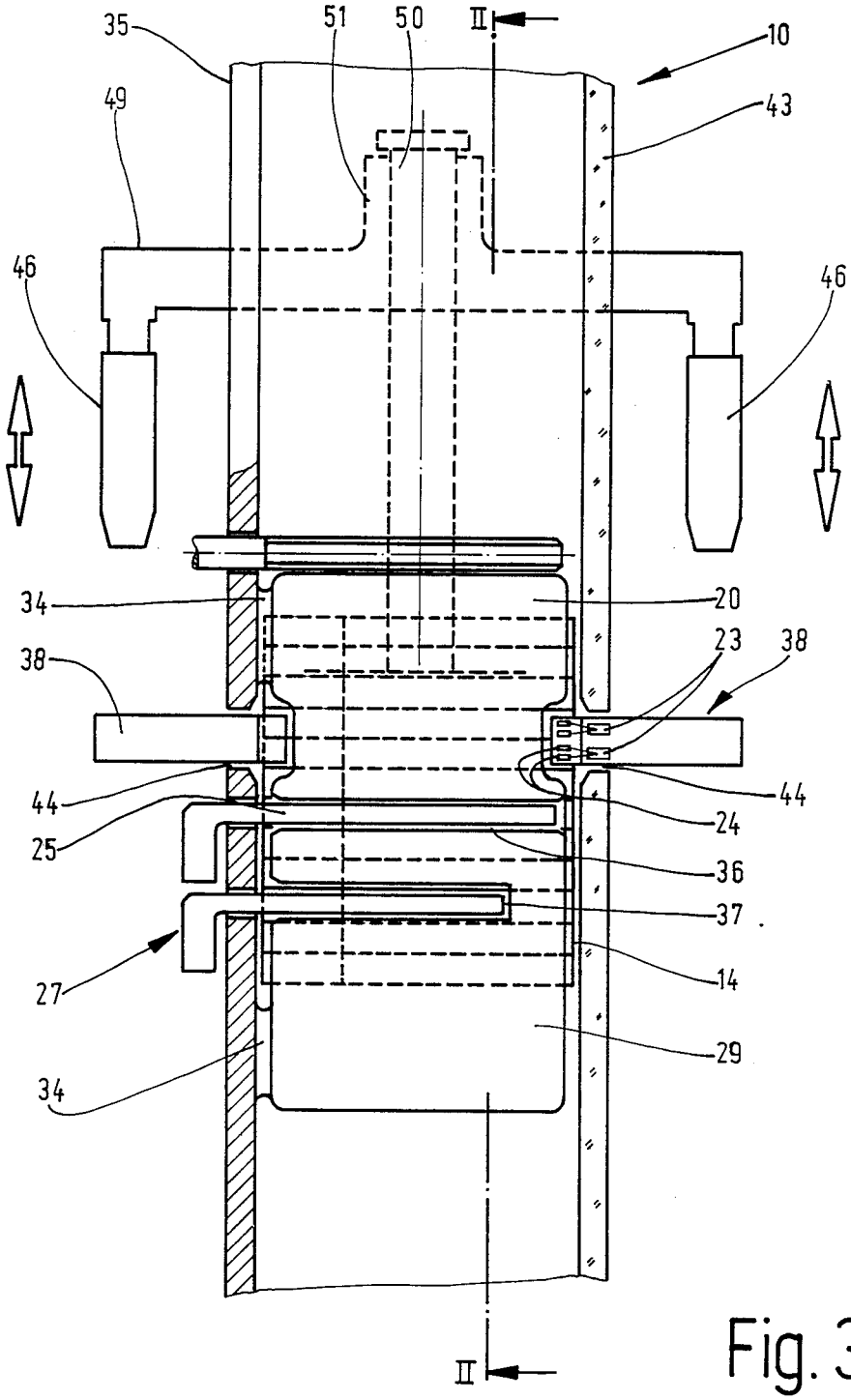
FIG. 3 shows a vertical section, transverse relative to FIG. 2, of the cigarette magazine in the region of the testing unit.
Figure 4:
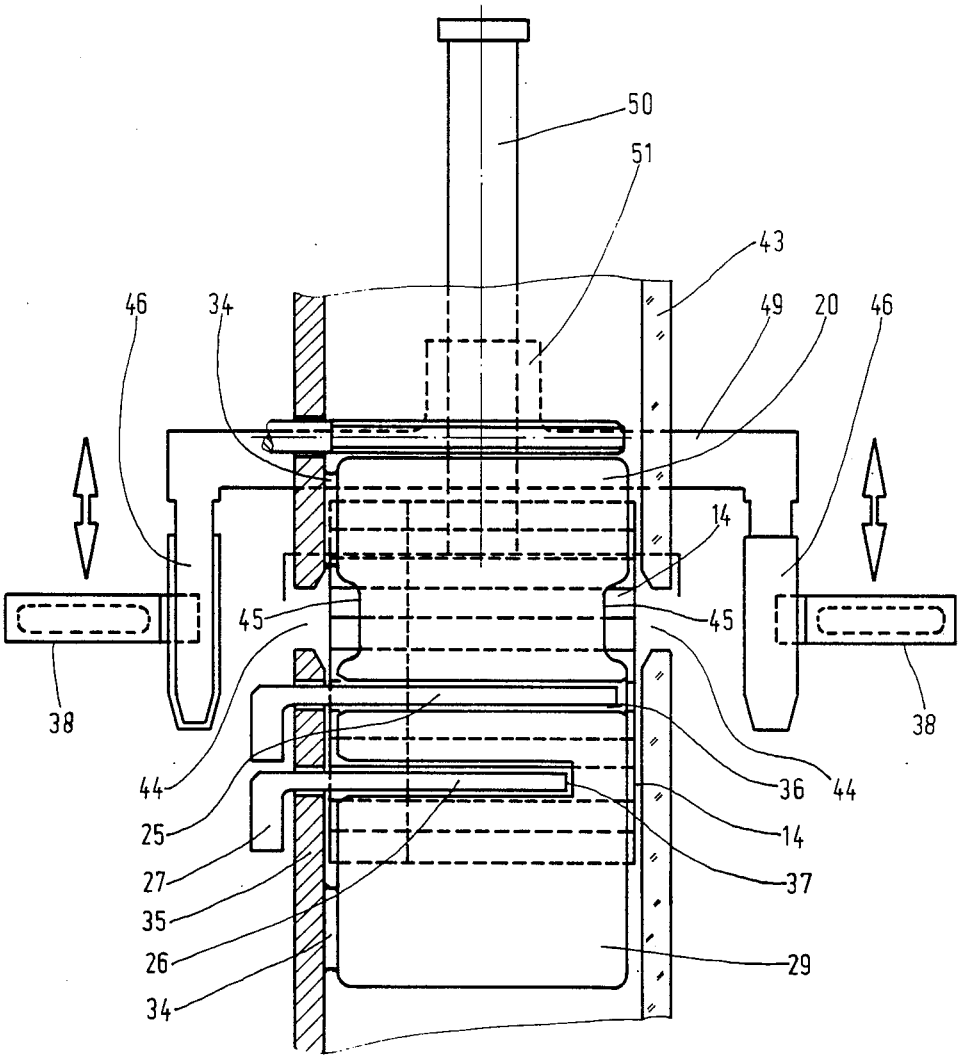
FIG. 4 shows a representation similar to that of FIG. 3, with cleaning tools in a changed relative position.

As is evident from FIGS. 3 and 4, the guide-shaft walls 29 are respectively connected to or made in one piece with the associated test-shaft walls 20. In the lower region of the guide-shaft walls 29, the continuous shaft walls 20/29 are connected respectively to a rear wall 35 of the cigarette magazine 10 by means of a connecting web 34. In the one-piece shaft walls 20/29 are arranged transversely directed recesses 36 for receiving the clamping fingers 25 and shorter slots 37, particularly extending only over some of the transverse dimension of the shaft walls 20/29, and intended for the passage of the supporting webs 26 of the cigarette carrier 27. The abovementioned members are actuated outside the cigarette magazine 10, in particular next to the rear wall 35 (FIGS. 3 and 4).

The testing members, particularly the transmitters 23 and receivers 24, are arranged in a special way. For this, carriers for receiving all the testing members are arranged on both sides of the cigarette magazine 10. In the illustrated exemplary embodiments of the invention, these are test beams 38 (FIGS. 3, 4 and 5) and 39 (FIGS. 6 to 9). The transmitters 23 and receivers 24 assigned to each cigarette 14 are arranged on these test beams 38, 39.

In the exemplary embodiments shown, the cigarettes are tested on the transmitted-light principle. Light-emitting transmitters 23 are mounted at the end faces of the cigarettes. These are assigned receivers 24 arranged laterally next to the cigarettes 14. In the present case, for each cigarette 14, two receivers are arranged above one another and on both sides of the cigarettes, specifically adjacent to the end faces. A transmitter 23 therefore acts on four receivers 24.

Figure 9:
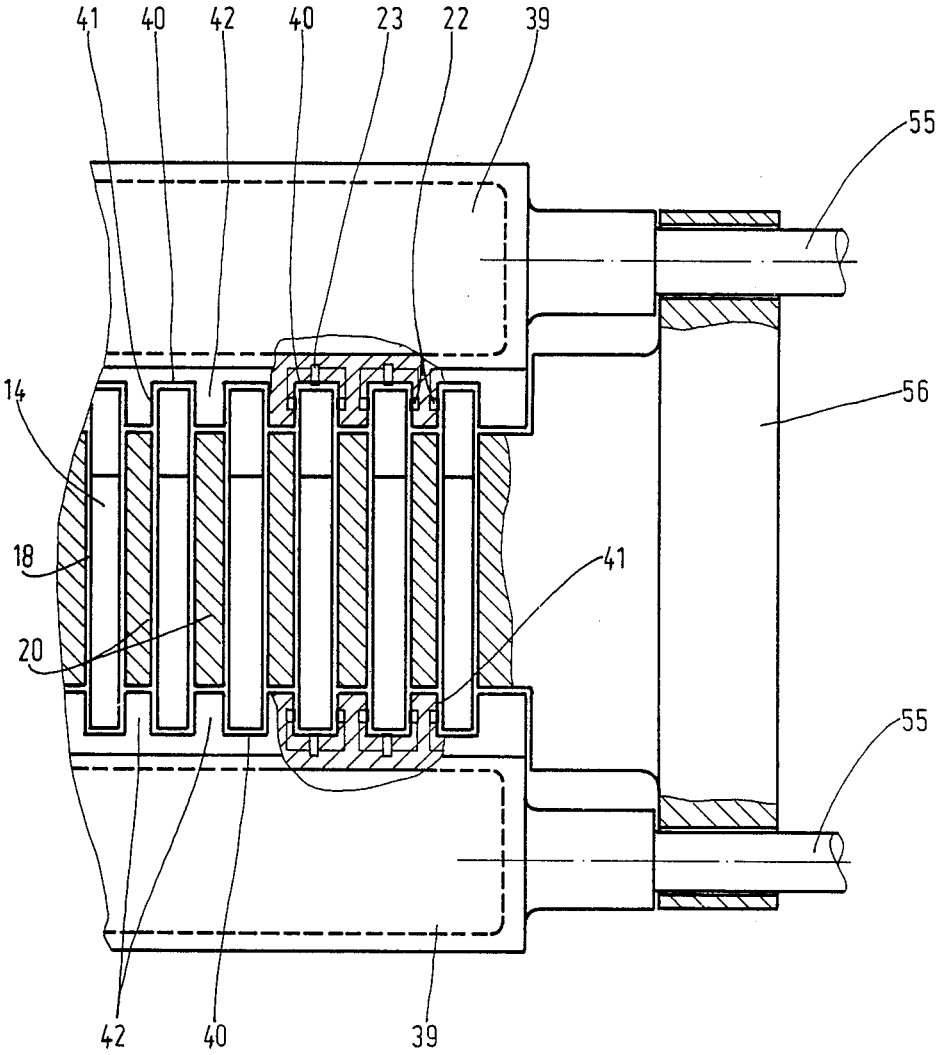
FIG. 9 shows a horizontal section at the level of the testing members, likewise in cutout form.

The test beams 38, 39 are made comb-like in view of the abovementioned test method. The transmitters 23 are located respectively in the region of recesses 40 (FIG. 9). The receivers 24 are mounted on transversely directed flanks 41 of comb-like projections 42. The transmitters 23 and receivers 24 are connected to an electronic evaluation circuit, appropriately within the hollow test beams 38, 39. Any error signals from the transmitters 23 and receivers 24 are evaluated by this and converted into control signals for a cigarette ejector (not shown).

The rear wall 35 of the cigarette magazine 10 and a front wall 43, which consists of transparent plastic in this particular case, are each equipped with a clearance 44 for the passage of the test beams 38, 39. As a result of an appropriate movement, the test beams 38, 39 can be advanced via the clearance 44 to the facing ends of the cigarettes 14 in the test plane 22. So that the projection 42 of the comb-like test beams 38, 39 can enter the region between the adjacent cigarettes 14, in this region, particularly adjacent to the clearance 44, the test-shaft walls 20 are equipped with an offset 45. This allows the projections 42 to enter between the cigarettes 14 because the test-shaft walls 20 are made with a smaller width. The receivers 24 are therefore arranged at the sides of the cigarettes.

Figure 5:
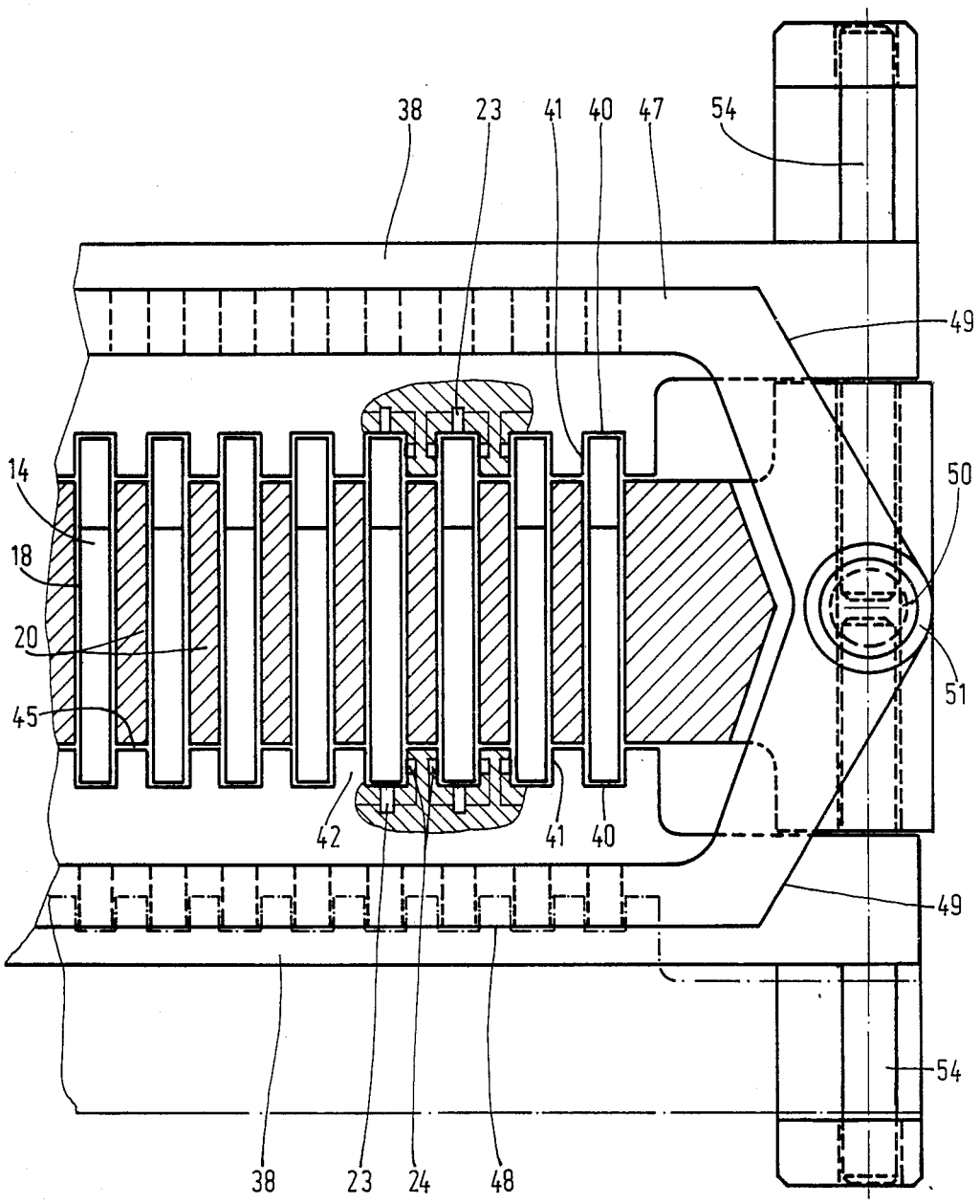
FIG. 5 shows a horizontal section through a cutout of the cigarette magazine in the region of the testing unit.
Figure 8:
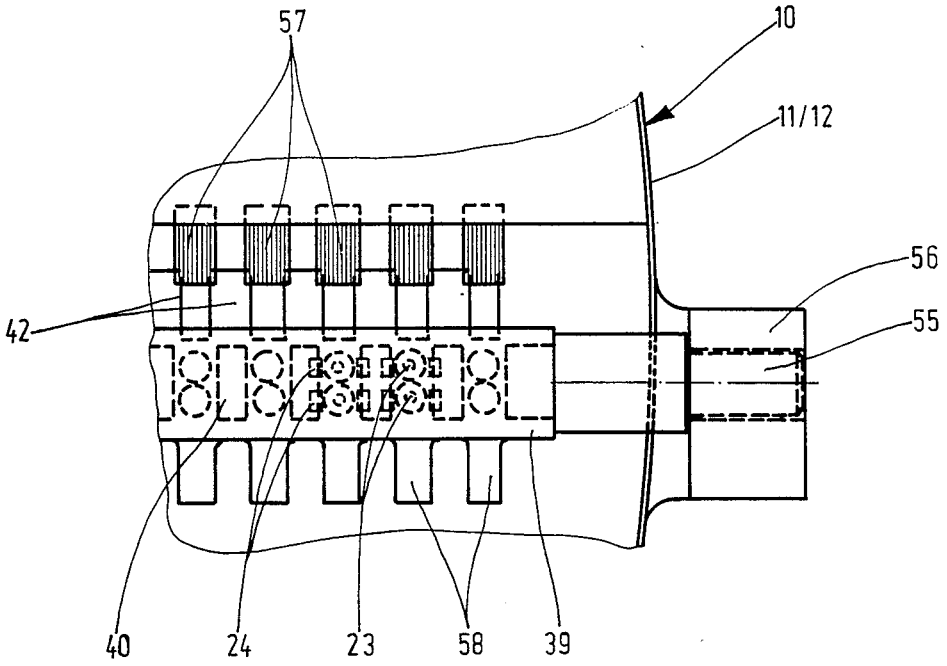
FIG. 8 shows a view of a portion of a test beam with a cutout of the cigarette magazine.

In the embodiment according to FIGS. 3 to 5, the test beams 38 are transversely movable, for example in a horizontal plane. In the testing position (FIG. 3), the test beam 38 passes through the clearance 44 by means of the projections 42. To carry out repairs, especially cleaning work, on the testing members, the test beams 38 can be retracted into a cleaning position according to FIG. 4.

In this position, dust, etc., can be cleared from the transmitters 23 and receivers 24 by cleaning tools. According to FIG. 4, cleaning brushes 46 are assigned to the test beams 38. The arrangement is such that a row of elongate vertical cleaning brushes 46 comes into engagement with each test beam 38. The appropriately designed cleaning brushes 46 enter the recesses 40 of the test beam 38, in such a way that the transmitters 23 arranged in the recesses 40 and the receivers 24 on the flanks 41 are cleaned. Cleaning takes place as result of a relative movement between the test beam 38 and cleaning brushes 46, in the present case by an up-and-down movement of the cleaning brushes 46.

Figure 2:
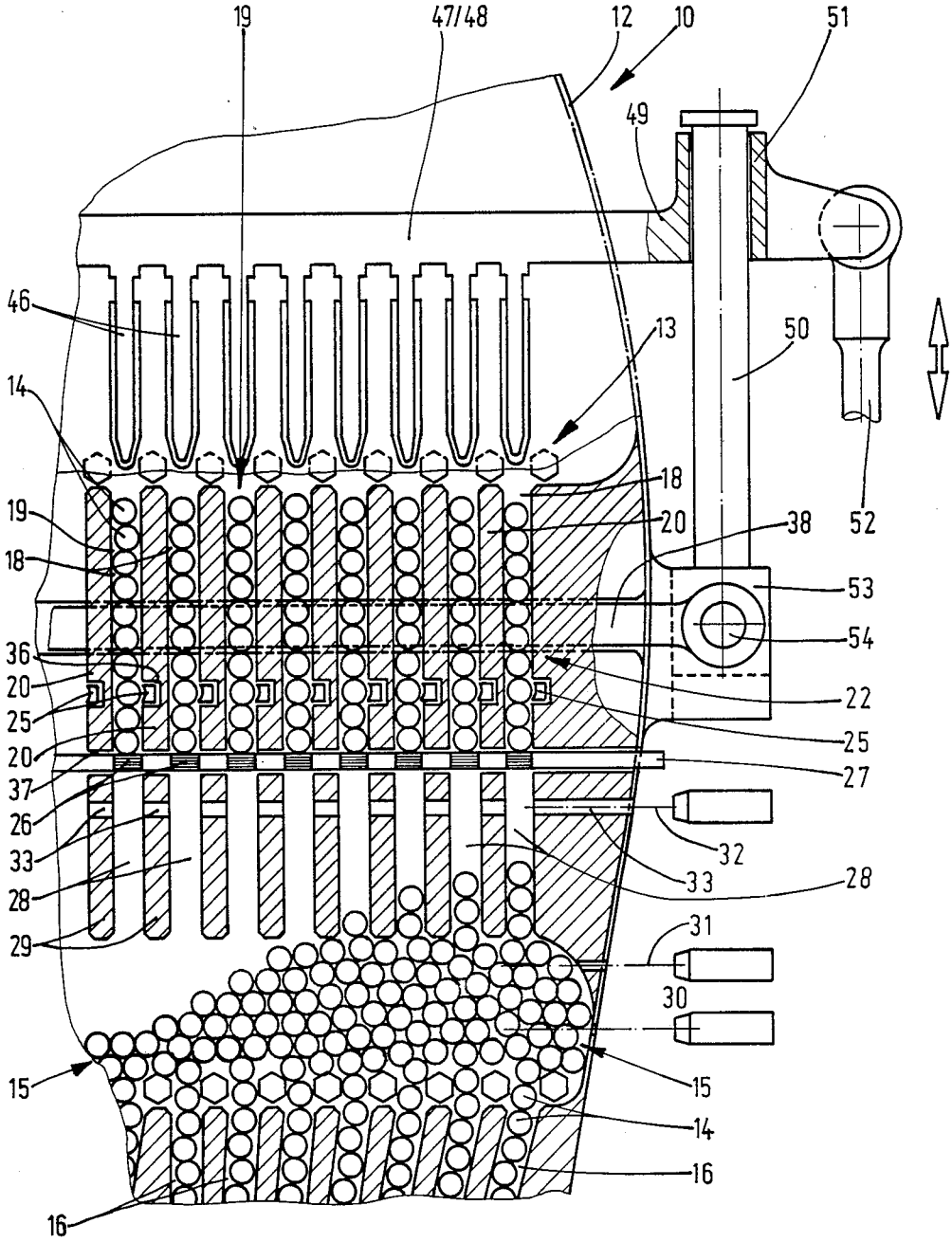

For this purpose, these are arranged on brush carriers 47, 48 extending laterally next to the cigarette magazine 10, specifically as overhanging members directed downwards. The brush carriers 47, 48 are connected to one another at the ends, next to the cigarette magazine 10, by means of a crosspiece 49. This in turn is connected to a vertical lifting bolt 50, on which the frame-like supporting structure consisting of the brush carriers 47, 48 and of the crosspiece 49 is movable up and down by means of a sliding bush 51. The latter can be driven in a suitable way, for example by a connecting rod 52 movable up and down (FIG. 2).

The lifting bolt 50 is supported on the bearing piece 53 which is connected laterally to the side walls 11, 12 of the cigarette magazine 10. The bearing piece 53 serves at the same time for fastening the test beams 38. These are mounted at their ends on transversely directed supporting journals 54. As result of a sliding movement on these supporting journals 54, the test beams 38 are shifted into the cleaning position or into the testing position.

In the embodiment according to FIGS. 6 to 9 too, the test beam 39 is mounted movably, in particular pivotably. For this purpose, the test beam 39 designed as a hollow body here too is equipped, at its ends, with bearing journals 55 which are mounted rotatably in a transverse support 56. This is connected to the cigarette magazine 10 or to the side walls 11 and 12. A suitable rotary drive (gear-wheel drive) ensures a to-and-fro oscillating rotational movement of the bearing journal 55 and consequently of the test beams 39.

In this exemplary embodiment too, the movement of the test beams 39 takes place mainly in order to clean the transmitters 23 and receivers 24. For this purpose, stationary cleaning brushes are assigned to the two test beams 39. As result of (multiple) pivoting movements of the test beams 39, these are moved with the projections 42 and recesses 40 past the cleaning brushes 57, so that the sensors are cleaned.

In the present exemplary embodiment, the cleaning brushes 57 are mounted on the rear wall 35 and front wall 43 of the cigarette magazine 10, specifically pointing downwards at an angle.

So that the clearances 44 in the rear wall 35 and front wall 43 are closed during the cleaning of the sensors or when the test beams 39 are in a position outside the testing position (FIG. 7), a closing segment 58 is attached to each of the test beams 39. This fits into the clearance 44.

What is claimed is:

1. An apparatus for the testing of cigarettes in conjunction with a magazine of a packaging machine, rows of cigarettes located above one another being guided through a testing unit and being tested in the region of vertical test shafts of the latter by testing members in a test zone situated in the testing unit and above a cigarette store formed by the test cigarettes, wherein straight vertical guide shafts (28) are formed as a continuation of the test shafts (18) underneath the test zone (13) and terminate above the cigarette store (15), and wherein vertical plane straight guide-shaft walls (29) limiting the guide shafts (28) are arranged in the same vertical planes as test-shaft walls (20) limiting the test shafts (18), so that tested intact cigarettes fall in an orderly and fault-free manner from said testing unit to the cigarette store.

2. An apparatus for the testing of cigarettes in conjunction with a magazine of a packaging machine, rows of cigarettes located above one another being guided through a testing unit and being tested in the region of vertical test shafts of the latter by optoelectrical testing members in a test zone situated in the testing unit and above a cigarette store formed by the tested cigarettes, wherein guide shafts (28) are formed as a continuation of the test shafts (18) underneath the test zone (13) and terminate above the cigarette store (15), and wherein the cigarette level in the cigarette store (15) is monitored by transversely directed check barriers comprising a lower check barrier (30) for switching off the packaging machine, a middle check barrier (31) for controlling the packaging machine or cigarette-producing machine in terms of their output and an upper check barrier (32) for switching off the cigarette-producing machine.

3. An apparatus as claimed in claim 2, wherein vertical plane guide-shaft walls (29) limiting the guide shafts (28) are arranged in the same planes as test-shaft walls (20) limiting the test shafts (18).

4. An apparatus as claimed in claim 1 or 2, wherein the test-shaft walls (20) and the guide-shaft walls (29) are connected to one another or are made in one piece and have recesses (36) or slots (37) for the reception or passage of transversely movable members (25, 26) of the testing unit (13).

5. An apparatus for the testing of cigarettes in conjunction with a magazine of a packaging machine, rows of cigarettes located above one another being guided through a testing unit and being tested in the region of vertical test shafts of the latter by optoelectrical testing members in a test zone situated in the testing unit and above a cigarette store formed by the tested cigarettes, wherein guide shafts (28) are formed as a continuation of the test shafts (18) underneath the test zone (13) and terminate above the cigarette store (15), wherein said optoelectrical testing members (23, 24) are active in the region of the ends of the cigarettes, and wherein the testing members are arranged on a common test beam (38, 39) and are movable by means of the latter into, and retractably out of a testing position.

6. An apparatus as claimed in claim 5, wherein said testing members comprise transmitters (23), assigned to end faces of the cigarettes, and receivers (24) assigned to the lateral end region of the cigarettes, said transmitters and receivers being arranged on said common test beam (38, 39) which is made comb-like for receiving the transmitters (23) in the region of recesses (40) and the receivers (24) in the region of flanks (41) of projections (42).

7. An apparatus as claimed in claim 5 or 6, wherein the test beam (38, 39) is designed as an elongate hollow body for the reception of electronic switch elements.

8. An apparatus as claimed in claim 6 wherein the test beam (38) is movable into and retractable out of the testing position by means of a transverse movement, namely a to-and-fro movement transverse relative to the cigarette magazine (10).

9. An apparatus as claimed in claim 8, wherein test beams (38) are arranged on both sides of the cigarette magazine (10) and are mounted displaceably at their ends next to the cigarette magazine (10) on supporting members (54).

10. An apparatus as claimed in claim 8, wherein, in the position of the test beam (38) retracted from the cigarette magazine (10), cleaning members are advanced to the test beams (38) in the region of the testing members, said cleaning members comprising cleaning brushes (46) movable up and down and entering the region of the recesses (40) between the projections (42).

11. An apparatus as claimed in claim 5, wherein the test beam (39) is mounted pivotably and is movable out of and into the testing position by means of a pivoting movement.

12. An apparatus as claimed in claim 11, wherein the testing members of the test beams (39) are cleaned as a result of a multiple pivoting movement in relation to cleaning brushes (57) of fixed location.

13. An apparatus as claimed in claim 11, wherein clearances (44) are arranged in a rear wall (35) and front wall (43) of the magazine (10) for the passage of a region of the test beam having the testing members.

14. An apparatus as claimed in claim 13, wherein, with the test beam (38, 39) retracted or pivoted, the clearances (44) are closed by means of movable closing members (58).

* * * * *